US006186813B1

(12) United States Patent
Tomita et al.

(10) Patent No.: US 6,186,813 B1
(45) **Date of Patent: *Feb. 13, 2001**

(54) DOUBLE RETAINING CONNECTOR

(75) Inventors: Yoshinori Tomita; Naomi Suzuki, both of Shizuoka (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/805,051

(22) Filed: Feb. 24, 1997

(30) Foreign Application Priority Data

Feb. 23, 1996 (JP) ..... 8-036388

(51) Int. Cl.[7] ..... H01R 13/52
(52) U.S. Cl. ..... 439/271; 439/595
(58) Field of Search ..... 439/350, 352, 439/354, 357, 595, 271

(56) References Cited

U.S. PATENT DOCUMENTS 5,197,898 * 3/1993 Nagamine ..... 439/271
5,324,208 * 6/1994 Kodama et al. ..... 439/271
5,328,382 7/1994 Pawlicki ..... 439/273
5,362,261 11/1994 Puerner ..... 439/752
5,380,217 * 1/1995 Yagi et al. ..... 439/358
5,399,045 * 3/1995 Yoneda et al. ..... 439/357
5,711,684 * 1/1998 Inoue et al. ..... 439/357
5,713,761 * 2/1998 Okayasu ..... 439/271

FOREIGN PATENT DOCUMENTS 0277822 8/1988 (EP) .
0356222 2/1990 (EP) .
0374492 6/1990 (EP) .

* cited by examiner

*Primary Examiner*—Hien Vu
(74) *Attorney, Agent, or Firm*—Sughrue, Mion, Zinn, Macpeak & Seas, PLLC

(57) ABSTRACT

A connector includes a connector housing, terminal receiving chambers having a retaining lance for retaining a female terminal by elastic deformation, a front holder for retaining the female terminal relative to the connector housing in a double manner, a retaining arm for retaining the front holder on the connector housing, and a tapered guide portion formed by a slanting surface, formed on the connector housing, and a slanting surface movable in unison with the retaining arm of the front holder. The retaining arm is deformable in a direction perpendicular to a direction of deformation of the retaining lance.

5 Claims, 8 Drawing Sheets

DOUBLE RETAINING CONNECTOR

BACKGROUND OF THE INVENTION

This invention relates to a double retaining connector in which each terminal is retained in a double manner by a retaining lance, provided within a connector housing, and a retaining arm of a front holder.

One conventional double retaining connector is shown in FIGS. 14 to 16. The illustrated housing is a female one 102 of a pair of connector housings, and each female terminal 105, received in an associated terminal receiving chambers 102*c* in this female connector housing, is retained in a double manner by a retaining lance 102*a*, provided at an upper portion of the terminal receiving chamber 102*c*, and a front holder 103 attached to the female connector housing from the front side of the terminal receiving chambers 102.

Referring to the above double retaining construction in further detail, as shown in FIGS. 14 and 15, the plurality of terminal receiving chambers 102*c* are provided in two (upper and lower) rows in the female connector housing 102 made of a synthetic resin, and the retaining lance 102*c* is provided at an upper portion of each terminal receiving chamber 102*c*, and extends left (in the drawings) generally horizontally. With this construction, the female terminal 105, inserted and guided into the terminal receiving chamber 102*c* from the right side (FIG. 16), moves in the terminal receiving chamber 102*c*, with an upper surface 105*b* of its terminal portion 105*a* held in sliding contact with a lower end portion $\mathbf{102}a_1$ of the retaining lance 102*a*, and finally when a rear end $\mathbf{105}b_1$ of the upper surface 105*b* of the terminal portion 105*a* passes past the lower end portion $\mathbf{102}a_2$ of the retaining lance 102*a*, the retaining lance 102*a* is elastically restored to an initial position, thereby effecting a first-stage retaining of the female terminal 105.

The front holder 103, like the female connector housing 102, is molded of a synthetic resin, and as shown in FIGS. 14 and 15, the front holder 103 is attached to the female connector housing 102 from the front side of the terminal receiving chambers 102*c* of the female connector housing 102. When the front holder 103 is inserted into a front end portion of the female connector housing 102, with its insertion-side end 103*e* directed toward the female connector housing 102, a provisionally-retaining projection 103*g*, formed on an upper retaining arm 103*f*, first slides past an upper retaining projection 102*d* of the female connector housing 102, and the front holder 103 is provisionally retained on the female connector housing 102.

In this condition, when the front holder 103 is further inserted into the female connector housing 102, with a front end 103*d* of a retaining arm 103*a* of the front holder 103 lifted in a direction of arrow C (FIG. 15), a retaining projection 103*c*, formed on the retaining arm 103*a*, is engaged with a lower retaining projection 102*b* formed on the female connector housing 102, so that the front holder 103 is fixed relative to the female connector housing 102. As a result, a distal end portion of the retaining arm 103*a* of the front holder 103 contacts an upper surface $\mathbf{102}a_3$ of the retaining lance 102*a*, thereby preventing the retaining lance 102*a* from upward movement, and therefore the female terminal 105 is retained in a double manner relative to the female connector housing 102.

FIG. 15 shows a condition in which the female terminals 105 are retained in a double manner relative to the female connector housing 102. Right, left and lower slanting surfaces 102*f* are formed on a front end surface 102*e* of the lower terminal receiving chamber 102*c* of the female connector housing 102, and also a slanting surface 103*b* is formed on a front end surface 103*h* of the retaining arm 103*a* of the front holder 103, and these slanting surfaces 102*f* and 103*b* cooperate with one another to form a tapered guide portion 107 for an insertion port 106 through which a male terminal 104 is engaged with the female terminal 105.

In the above construction, as shown in FIG. 15, for engaging the male terminal 104, received in a male connector housing (not shown), with the female terminal 105, a front end portion 104*a* of the male terminal 104 is first guided into the insertion port 106 by the tapered guide portion 107, and is further moved into the terminal receiving chamber 102*c* in a direction of arrow D, and is engaged with the front end portion of the female terminal.

In the above conventional double retaining connector, however, when a distal end 104*b* of the front end metallic portion 104*a* of the male terminal 104 abuts against the upper slanting surface 103*b* during the insertion of the male terminal 104 into the terminal receiving chamber 102*c* as shown in FIG. 16, the retaining arm 103*a* can be moved upward in a direction of arrow E. As a result, the front end metallic portion 104*a* moves into the terminal receiving chamber 102*c* without being guided by the slanting surface 103*b*, and the distal end 104*b* of the front end portion 104*a* impinges on an upper portion of the front end surface of the front end portion (terminal portion) 105*a* of the female terminal 105, so that the male terminal 104 can not move further, and therefore the male terminal 104 can not be engaged with the female terminal 105.

SUMMARY OF THE INVENTION

The present invention has been made in view of the problems of the above conventional double retaining connector, and an object of the invention is to provide a double retaining connector in which a male terminal can be smoothly inserted into a terminal receiving chamber by a tapered guide portion.

Another object of the invention is to provide a double retaining connector in which a male terminal can be smoothly inserted into a terminal receiving chamber even when the male terminal to be inserted into an insertion portion abuts against any one of sides of a rectangular, tapered guide portion.

According to a first aspect of the invention, there is provided a double retaining connector comprising a connector housing; a terminal receiving chamber formed within the connector housing, a female terminal being inserted into the terminal receiving chamber through one insertion portion thereof while a male terminal is inserted into the terminal receiving chamber through the other insertion portion thereof, and is engaged with the female terminal; a retaining lance which extends from an inner surface of the terminal receiving chamber, and retains the female terminal, received in the terminal receiving chamber, by elastic deformation; a front holder which is attached to the connector housing from that side of the terminal receiving chamber, through which the male terminal is inserted into the chamber, and is fixed to the connector housing, thereby preventing deformation of the retaining lance so as to retain the female terminal relative to the connector housing in a double manner; a retaining arm which is formed integrally with the front holder, and retains the front holder on the connector housing by elastic deformation; and a tapered guide portion for guiding the male terminal into the terminal receiving chamber, the tapered guide portion being formed by a slanting surface, formed on the connector housing, and a slanting surface movable in unison with the retaining arm of the front holder; wherein the retaining arm is deformable in a direction perpendicular to a direction of deformation of the retaining lance.

According to a second aspect of the invention, in the double retaining connector of the first aspect of the invention, the insertion portion of the terminal receiving chamber, through which the male terminal is inserted into the terminal receiving chamber, has an opening of a generally rectangular cross-section, and the tapered guide portion is formed around the insertion portion in a generally rectangular shape, and at least part of sides of the tapered guide portion is formed by the slanting surface on the connector housing.

In the invention of the first aspect, the retaining arm, which retains the front holder on the connector housing by elastic deformation, is deformable in the direction perpendicular to the direction of deformation of the retaining lance which retains the female terminal, received in the terminal receiving chamber, by elastic deformation. Therefore, the ratio of the slanting surface on the front holder to the tapered guide portion can be kept to a minimum.

In the invention of the second aspect, at least part of the sides of the rectangular, tapered guide portion is formed by the slanting surface on the connector housing. Therefore, even when the male terminal to be inserted into the insertion portion abuts against any of the sides of the rectangular, tapered guide portion, the male terminal abuts against the slanting surface on the connector housing which surface is not elastically deformable.

DETAILED DESCRIPTION OF THE INVENTION

Preferred embodiments of a double retaining connector of the present invention will now be described with reference to the drawings.

Figure 1:
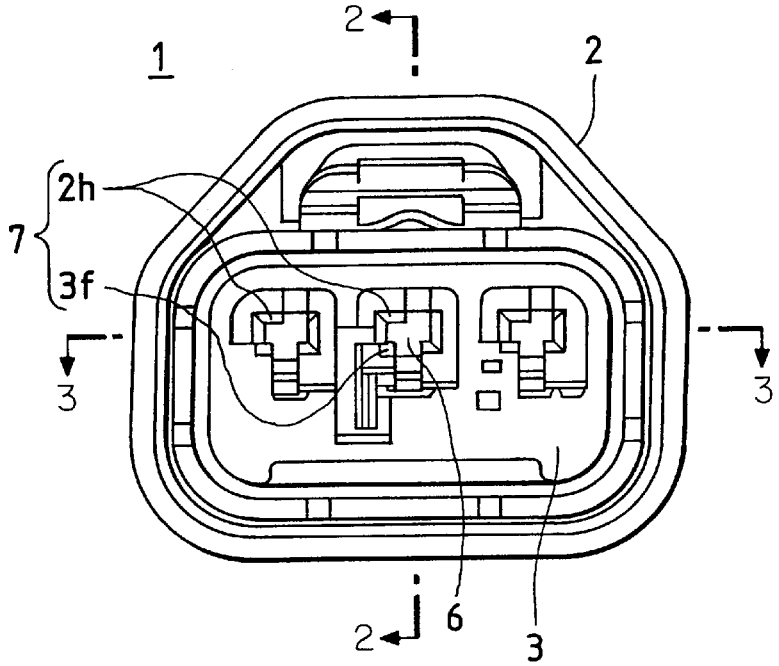
FIG. 1 is a front-elevational view of a preferred embodiment of a double retaining connector of the present invention.
Figure 2:
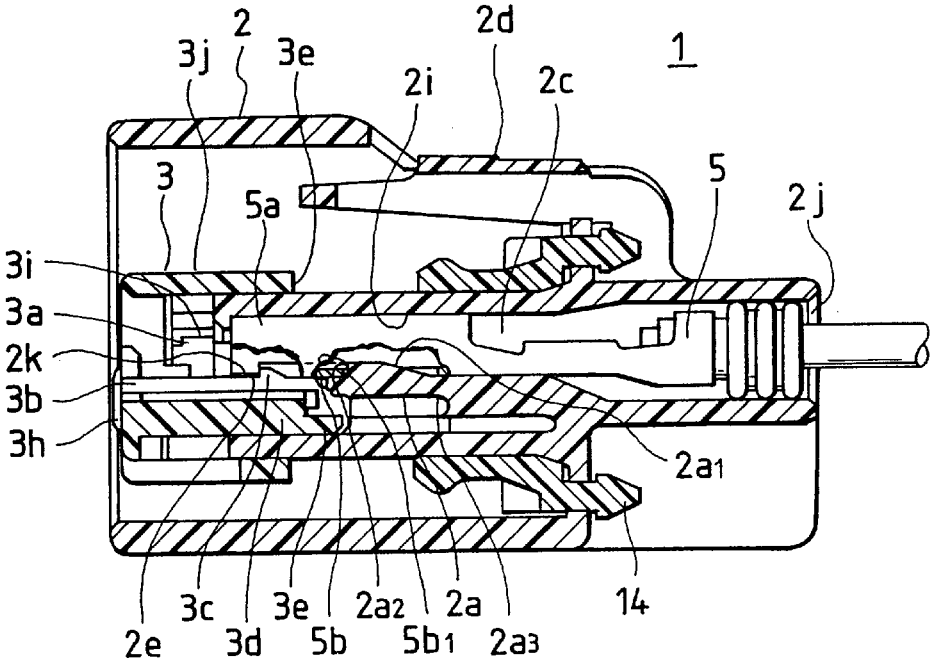
FIG. 2 is a cross-sectional view of the double retaining connector taken along line I—I of FIG. 1.
Figure 3:
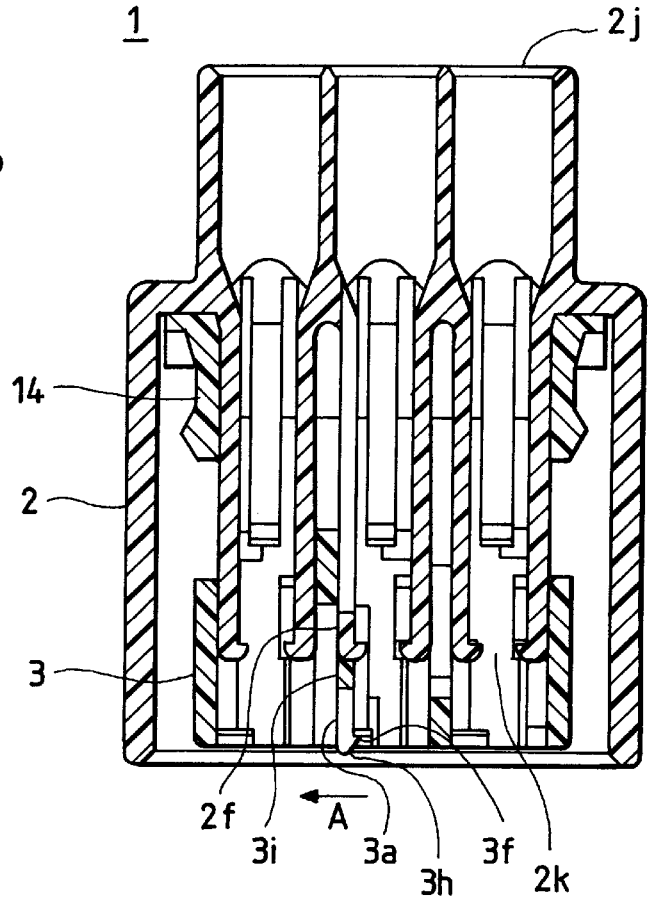
FIG. 3 is a cross-sectional view of the double retaining connector taken along line II—II of FIG. 1.

FIGS. 1 to 3 show one preferred embodiment of the double retaining connector of the invention. The double retaining connector 1 of the present invention, like the above conventional double retaining connector 101, comprises a female connector housing 2 and a front holder 3, and further comprises a packing 14 forming a seal between the female connector housing 2 and the front holder 3. As in the conventional double retaining connector, each female terminal 5 is retained in a double manner relative to the female connector housing 2 by a retaining lance 2*a*, provided in a terminal receiving chamber 2*c* of the female connector housing 2, and the front holder 3 attached to the female connector housing 2 from the rear side of the terminal receiving chambers 2*c*.

FIGS. 6 to 9 show the female connector housing 2. The female connector housing 2 is made of a synthetic resin, and has the plurality of terminal receiving chambers 2*c* provided within a tubular hood portion 2*b* for receiving the female terminals 5, respectively. Each terminal receiving chamber 2*c* has an insertion port 2*j* for the insertion of the female terminal 5 therethrough, and an insertion port 2*k* through which a male terminal 4 is inserted to be engaged with the female terminal 5. The retaining lance 2*a* extends left (in the drawings) generally horizontally from a lower surface of each terminal receiving chamber 2*c*, and a retaining end $2a_2$ for engagement with a terminal metallic portion 5*a* of the female terminal 5 is formed on an upper end surface $2a_1$ of the retaining lance 2*a*.

A slanting surface 2*h* for guiding the insertion of the male terminal 4 into the terminal receiving chamber 2*c* is formed around the male terminal insertion port 2*k* of each terminal receiving chamber 2*c*. Because of the necessity of molding the retaining lance 2*a*, this slanting surface 2*h* can not be formed continuously over the entire periphery of the insertion port 2*k*, and cooperates with a slanting surface 3*f* (described later), formed on the front holder 3, to form a tapered guide portion 7 (FIG. 1).

Figure 7:
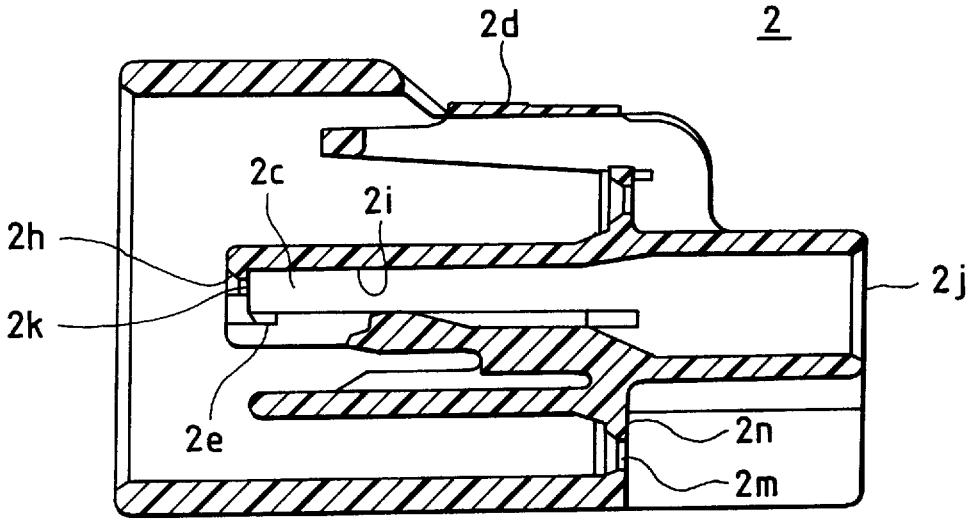
FIG. 7 is a cross-sectional view taken along line III—III of FIG. 6.
Figure 8:
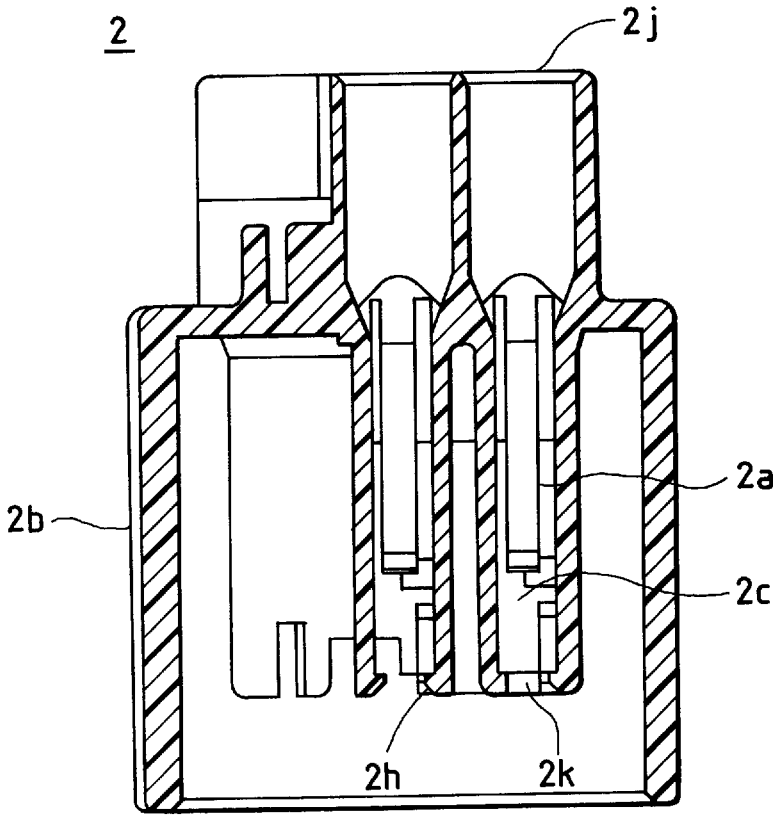
FIG. 8 is a cross-sectional view taken along line IV—IV of FIG. 6.
Figure 9:
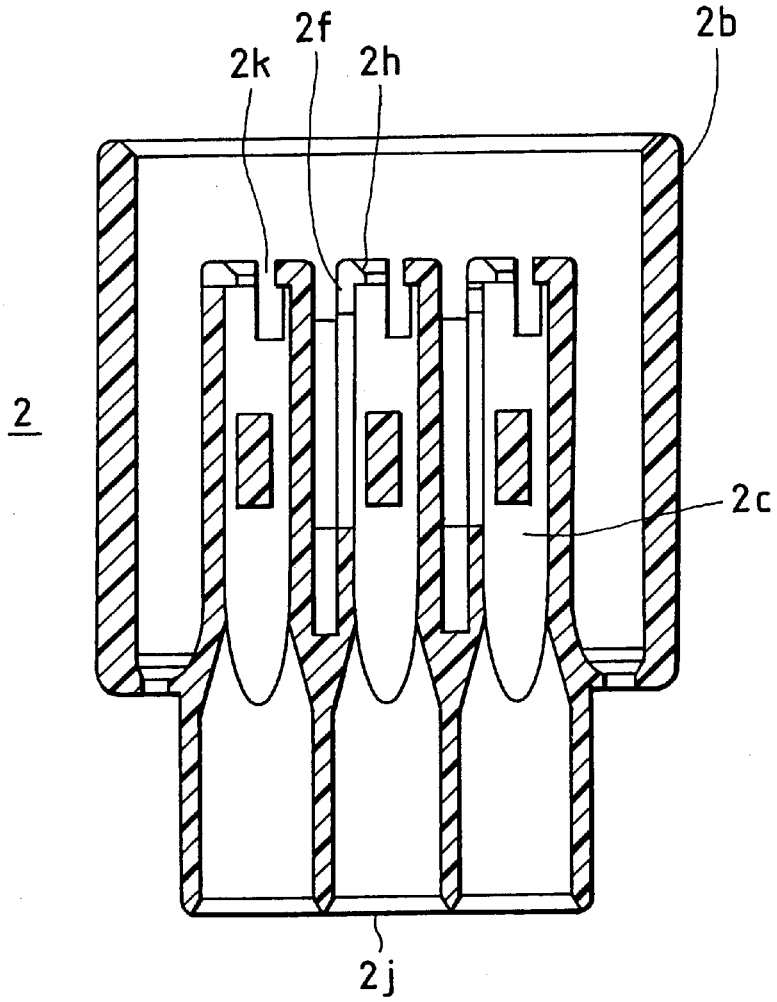
FIG. 9 is a cross-sectional view taken along line V—V of FIG. 6.
Figure 10:
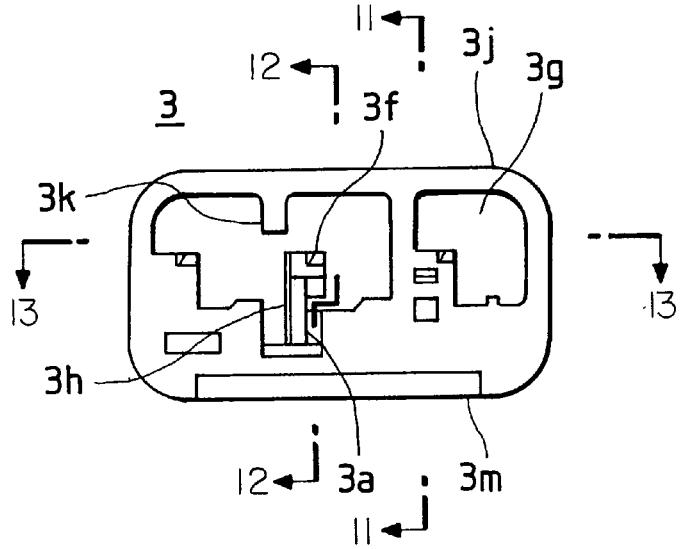
FIG. 10 is a front-elevational view of the front holder used in the double retaining connector of FIG. 1.

As shown in FIG. 7, in the female connector housing 2, a provisionally-retaining projection 2*e* for engagement with a provisionally-retaining projection 3*c* on the front holder 3 is formed on a side wall. As shown in FIG. 9, part of the side wall of the intermediate terminal receiving chamber 2*c* is notched to form an engagement portion 2*f* which is adapted to be engaged with a completely-retaining projection 3*i* (described later) of the front holder 3 to thereby fix the front holder 3 relative to the female connector housing 2. An elastic retaining arm 2*d* is formed on the female connector housing 2, and the female connector housing 2 is retained relative to a mating male connector housing (not shown) by this elastic retaining arm 2*d*. A packing insertion hole 2*m* for the insertion of the packing 14 therethrough is formed through a vertical wall 2*n*.

Next, the front holder 3 will be described with reference to FIGS. 10 to 13. The front holder 3, like the in female connector housing 2, is molded of a synthetic resin, and an internal space of a frame 3*j* is partitioned by side walls 3*k* into spaces 3*g* which communicate respectively with the terminal receiving chambers 2*c* of the female connector housing 2 when the front holder 3 is attached to the female connector housing 2. A completely-retaining arm 3*a*, formed integrally with a bottom portion 3*m* at a front end portion thereof, is in the form of a vertically-extending flat plate, and the completely-retaining projection 3*i* for engagement with the engagement portion 2*f* of the female connector housing 2 is formed on an upper edge of the completely-retaining arm 3*a*. A projection 3*h* is formed at a free end of the completely-retaining arm 3*a*, and the completely-retaining arm 3*a* is elastically deformed left (that is, in a direction of arrow B in FIG. 13) by this projection 3*h*. The slanting surface 3*f* is formed at the free end of the completely-retaining arm 3*a*, and cooperates with the slanting surface 2*h* of the female connector housing 2 to form the tapered guide portion 7.

Figure 11:
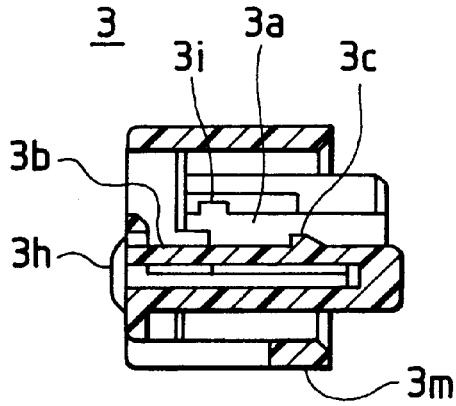
FIG. 11 is a cross-sectional view taken along line VI—VI of FIG. 10.
Figure 12:
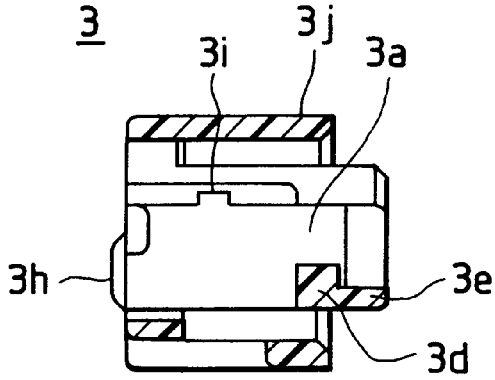
FIG. 12 is a cross-sectional view taken along line VII—VII of FIG. 10.
Figure 13:
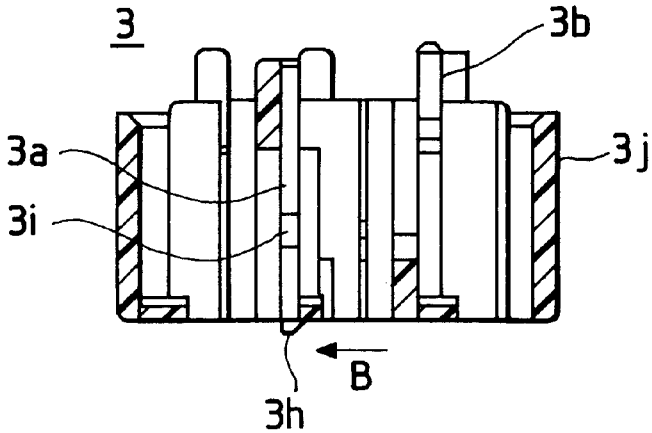
FIG. 13 is a cross-sectional view taken along line VIII—VIII of FIG. 10.
Figure 14:
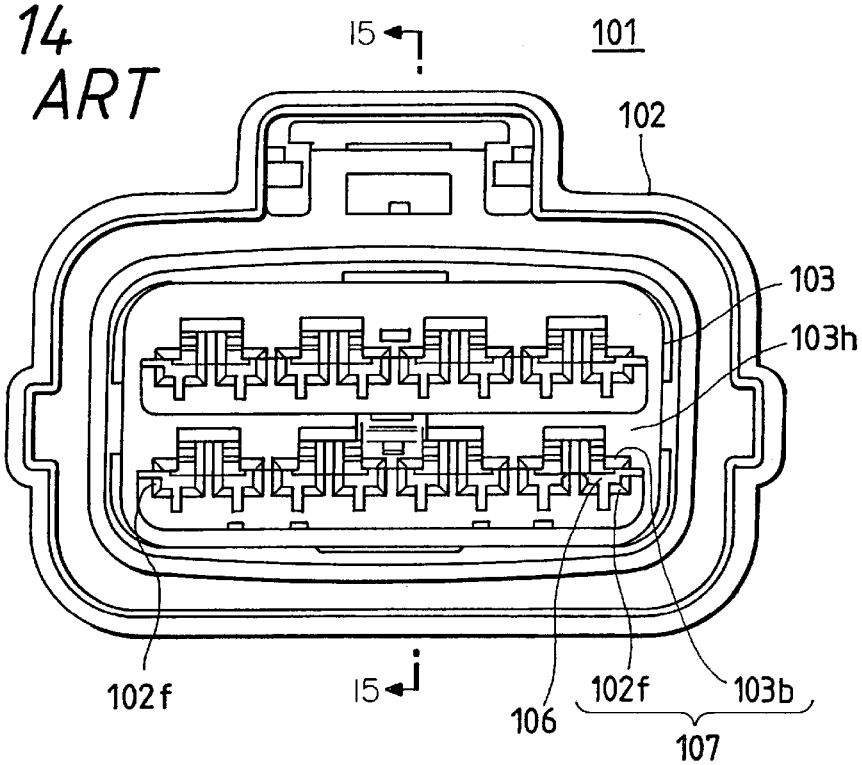
FIG. 14 PRIOR ART
FIG. 14 is a front-elevational view of a conventional double retaining connector.
Figure 15:
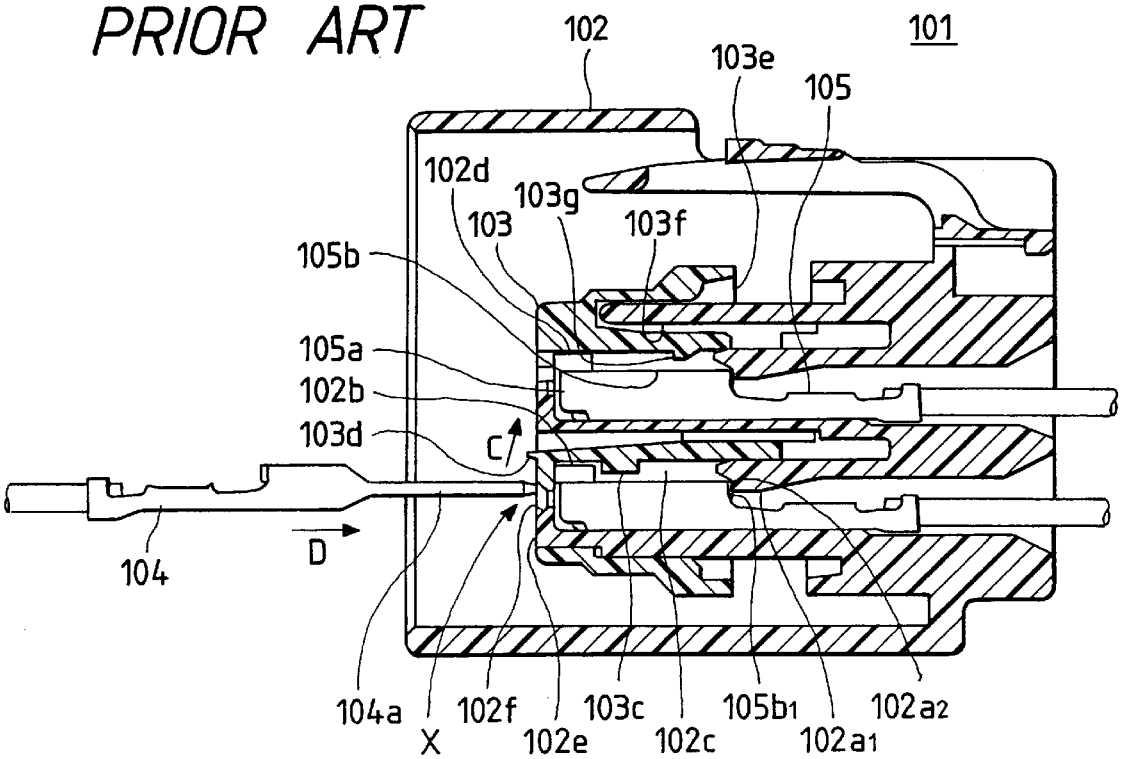
FIG. 15 PRIOR ART
FIG. 15 is a cross-sectional view taken along line IX—IX of FIG. 14.

As clearly shown in FIG. 11, a provisionally-retaining arm 3*b* extends above the bottom plate 3*m*, and the provisionally-retaining projection 3*c* is formed on the provisionally-retaining arm 3*b*. This provisionally-retaining projection 3*c* performs its function when the front holder 3 is provisionally retained on the female connector housing 2. An end portion 3*e* is formed on a lower extension portion 3*d* of the completely-retaining arm 3*a*, and functions to cause the female terminal 5 to be retained relative to the female connector housing 2 in a double manner when the front holder 3 is completely retained on the female connector housing 2.

As shown in FIGS. 2 to 5, the packing 14 is first attached to the female connector housing 2 through the packing insertion hole 2*m*, and then forms a seal between the female connector housing 2 and the front holder 3 to prevent water or the like from intruding from the exterior into the terminal receiving chambers 2*c* when the front holder 3 is attached to the female connector housing 2.

The operation of the double retaining connector 1 of the above construction will now be described.

First, the female terminal 5 is inserted into the terminal receiving chamber 2*c* of the female connector housing 2, and is fixed therein. More specifically, the female terminal 5, inserted through the female terminal insertion port 2*j*, moves in the terminal receiving chamber 2*c*, with a lower surface 5*b* of the terminal metallic portion 5*a* held in sliding contact with the upper end surface $2a_1$ of the retaining lance 2*a*, and finally when an engagement end 5*b*of a retaining hole in the lower surface 5*b* of the terminal metallic portion 5*a* passes past the retaining end $2a_2$ of the retaining arm 2*a*, the retaining lance 2*a* is elastically restored to its initial position, thereby effecting a first-stage retaining of the female terminal 5 by the retaining lance 2*a*.

Then, the front holder 3 is attached to the female connector housing 2 from the front side of the terminal receiving chambers 2*c* of the female connector housing 2. More specifically, when the front holder 3 is inserted into the front end portion of the female connector housing 2, with its insertion-side end 3*e* first introduced into the female connector housing 2, the provisionally-retaining projection 3*c*, formed on the provisionally-retaining arm 3*b*, first slides past the provisionally-retaining projection 2*e* on the female connector housing 2, so that the front holder 3 is provisionally retained on the female connector housing 2.

In this condition, as shown in FIG. 3, the front end portion 3*h* of the completely-retaining arm 3*a* of the front holder 3 is urged and elastically deformed left (that is, in the direction of arrow A), and in this condition, when the front holder 3 is further inserted into the female connector housing 2, the completely-retaining projection 3*i*, formed on the completely-retaining arm 3*a*, slides past the engagement portion 2*f* of the terminal receiving chamber 2*c* of the female connector housing 2, so that the retaining arm 3*a* is elastically restored, thereby fixing the front holder relative to the female connector housing 2. This condition is shown in FIGS. 4 and 5, and the end portion 3*e* of the lower extension portion 3*d* of the front holder 3 is engaged with a lower surface $2a_3$ of the retaining lance 2*a* to prevent the downward movement of the retaining lance 2*a*, and therefore the double retaining of the female terminal 5 relative to the female connector 2 is achieved.

Figure 4:
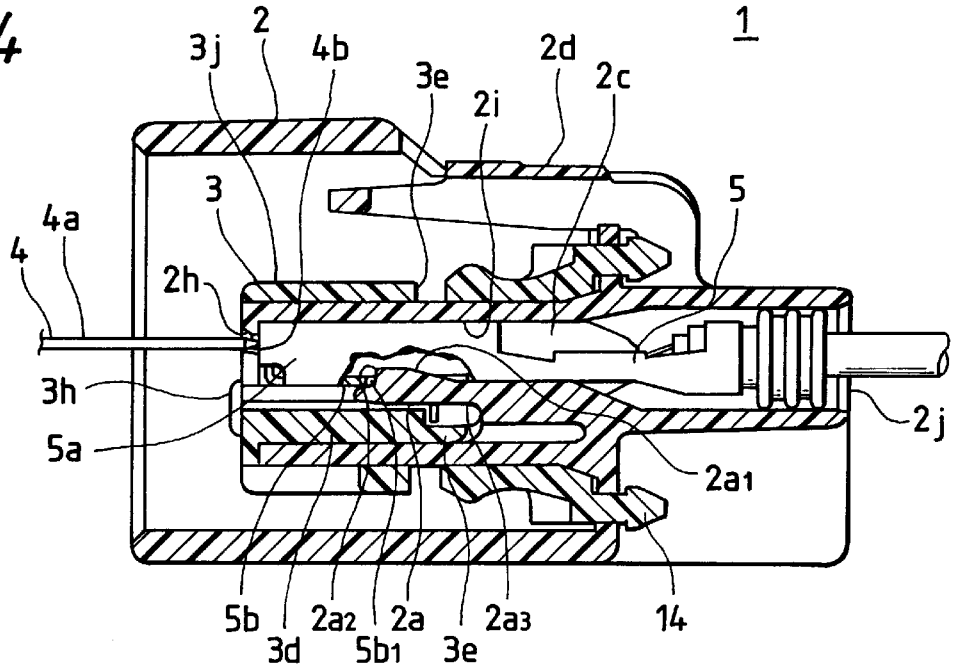
FIG. 4 is a cross-sectional view similar to the cross-sectional view taken along line I—I of FIG. 1, showing a completely-retained condition of a connector housing and a front holder of the double retaining connector of FIG. 1.
Figure 5:
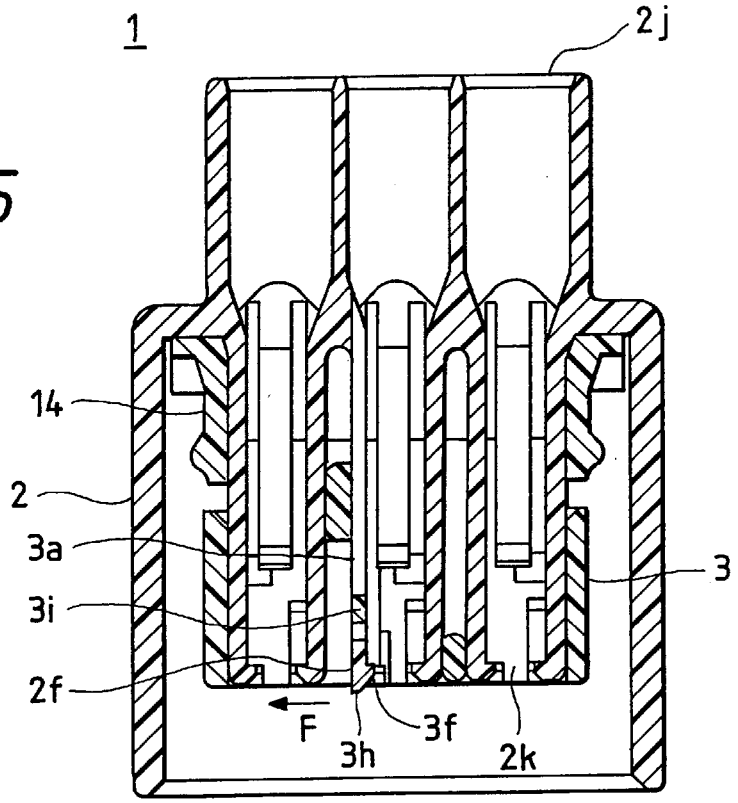
FIG. 5 is a cross-sectional view similar to the cross-sectional view taken along line II—II of FIG. 1, showing the completely-retained condition of the connector housing and the front holder of the double retaining connector of FIG. 1.
Figure 6:
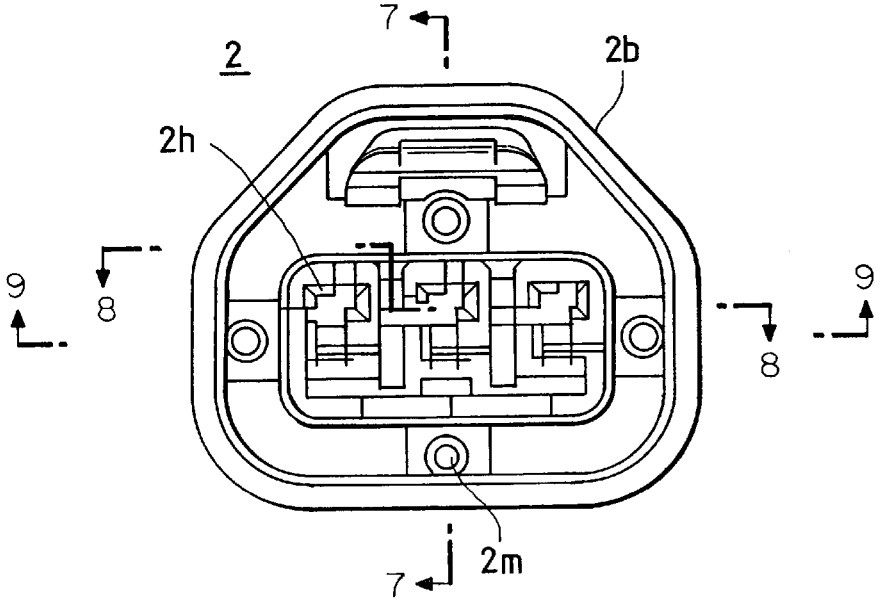
FIG. 6 is a front-elevational view showing the female connector housing used in the double retaining connector of FIG. 1.

FIG. 4 shows the condition in which the female terminal 5 is retained relative to the female connector housing 2 in a double manner, and in this condition, the male terminal 4, received in the male connector housing (not shown) passes through an insertion port 6, formed in the front holder 3, and is brought into engagement with the female terminal 5. At this time, a front metallic end portion 4*a* of the male terminal 4 is guided into the insertion port 6 by the tapered guide portion 7 (FIG. 1), and is further inserted into the terminal receiving chamber 2*c* to be engaged with the front metallic end portion of the female terminal 5.

Figure 16:
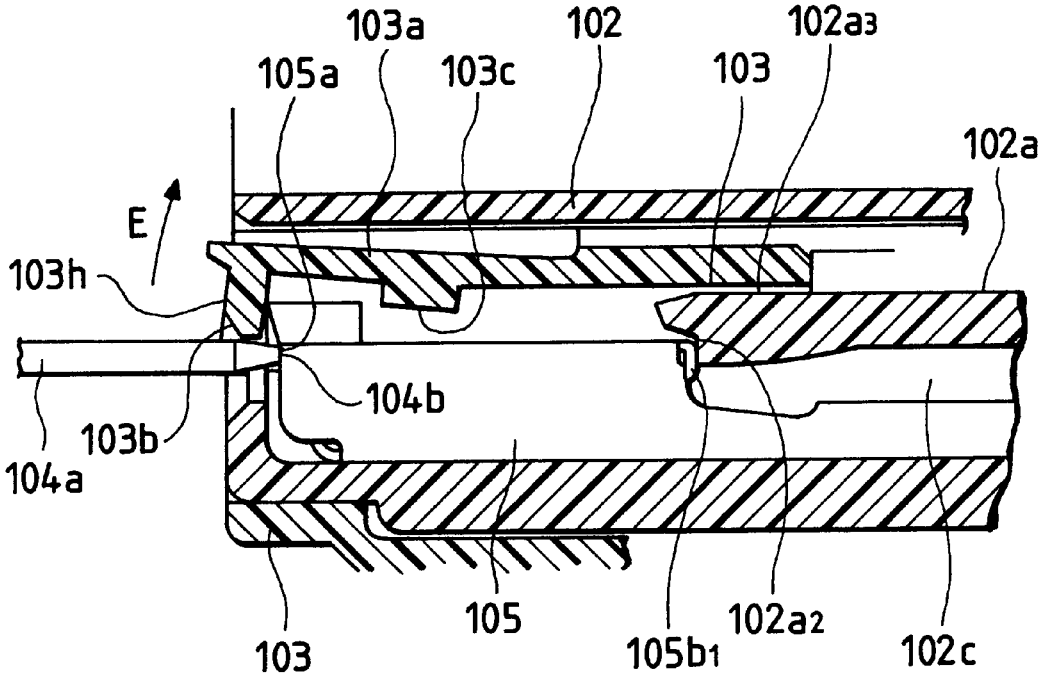
FIG. 16 PRIOR ART
FIG. 16 is an enlarged view of a portion X of FIG. 15.

In the conventional double retaining connector, when the distal end 104*b* of the front end portion 104*a* of the male terminal 104 abuts against the upper tapered guide portion 103*b*, the retaining arm 103*a* can be moved upward (that is, in the direction of arrow E) as shown in FIG. 16, and as a result, the front metallic end portion 104*a* moves into the terminal receiving chamber 102*c* without being guided by the tapered guide portion 103*b*, and the distal end 104*b* of the front end portion 104*a* impinges on the upper portion of the front end surface of the front end portion (terminal portion) 105*a* of the female terminal 105, so that the male terminal 104 can not move further, and therefore the male terminal 104 can not be engaged with the female terminal 105.

In the double retaining connector of the present invention, however, even when a distal end 4*b* of the front metallic end portion 4*a* of the male terminal 4 abuts against the upper slanting surface 2*h* as shown in FIG. 4, an upper wall 2*i* of the terminal receiving chamber, on which the slanting surface 2*h* is formed, will not move upward, and the front metallic end portion 4*a* is suitably guided into the terminal receiving chamber 2*c* by the slanting surface 2*h*. As a result, the male terminal 4 can be engaged with the female terminal 5 without impingement of the distal end 4*b* of the front metallic end portion upon the front upper end portion of the terminal portion 5*a* of the female terminal 5.

In this embodiment, the completely-retaining arm 3*a* is movable left (FIG. 5), that is, in the direction of arrow F, and therefore when the distal end 4*b* of the front metallic end portion 4*a* of the male terminal 4 abuts against the slanting surface 3*f* formed on the completely-retaining arm 3*a*, this slanting surface 3*f* is moved left, and therefore the front end portion 4*a* moves toward the insertion port 6 without being guided by the slanting surface 3*f*. However, since the immovable slanting surface 2*h* on the housing is present in the vicinity of the slanting surface 3*f* on the front holder, the front metallic end portion 4*a* of the male terminal 4 is guided by this slanting surface 2*h* on the housing, so that the male terminal 4 can be engaged with the female terminal 5 without impingement of the distal end 4*b* of the front metallic end portion 4*a* upon the side wall of the female terminal 5 at the front end thereof.

As described above, in the invention of the first apect, the ratio of the slanting surface on the front holder to the tapered guide portion for guiding the male terminal into the terminal receiving chamber can be kept to a minimum, and therefore the male terminal can be smoothly inserted into the terminal receiving chamber by the tapered guide portion.

Further, in the invention of the second aspect, even when the male terminal to be inserted into the insertion portion abuts against any of the sides of the rectangular, tapered guide portion, the male terminal abuts against the slanting surface on the connector housing which surface is not elastically deformable, and therefore the male terminal can be smoothly inserted into the terminal receiving chamber by the tapered guide portion.

What is claimed is:

1. A double retaining connector, comprising:

a connector housing having (1) a first end, (2) a second end, and (3) a terminal receiving chamber for receiving a first terminal and a second terminal, said first terminal being insertable into said terminal receiving chamber via a first terminal insertion opening provided in said first end of said connector housing and said second terminal being insertable into said terminal receiving chamber via a second terminal insertion opening provided in said second end of said connector housing, said second terminal insertion opening partially defined by a first slanting surface of said connector housing;

a retaining lance extended from said connector housing into said terminal receiving chamber, said retaining lance being elastically deflectable to retain said first terminal in said terminal receiving chamber;

a front holder attachable to said second end of said connector housing and having a portion for abutting said retaining lance to prevent deflection of said retaining lance; and a retaining arm formed integrally with said front holder, said retaining arm being elastically deflectable to retain said front holder on said connector housing, said retaining arm having a free end provided with a second slanting surface;

wherein, when said front holder is attached to said connector housing such that said portion of said front holder abuts said retaining lance, said first and said second slanting surfaces form a tapered guide portion around said second terminal opening for guiding said second terminal into said terminal receiving chamber; and wherein said retaining arm is deflectable in a sideways direction and said retaining lance is deflectable in an up and down direction, said sideways direction being perpendicular to said up and down direction.

2. A double retaining connector according to claim 1, wherein said tapered guide portion has a substantially rectangular shape.

3. A double retaining connector according to claim 1, wherein said retaining lance is elastically deflectable between a retaining position and a deflected position, such that (1) as said first terminal is inserted into said terminal receiving chamber, said first terminal influences said retaining lance from said retaining position to said deflected position, and (2) once said first terminal is fully inserted into said terminal receiving chamber, said retaining lance elastically returns to said retaining position to retain said first terminal in said terminal receiving chamber.

4. A double retaining connector according to claim 1, wherein said retaining arm is deflectable between a retaining position and a deflected position, such that, to abut said portion of said front holder against said retaining lance, said retaining arm must first be deflected from said retaining position to said deflected position.

5. A double retaining connector according to claim, wherein said tapered guide portion has four sides that substantially form a rectangle, and said first slanting surface of said connector housing forms at least a portion of each of said four sides.

* * * * *